United States Patent [19]

Dobbins

[11] Patent Number: 4,785,927

[45] Date of Patent: Nov. 22, 1988

[54] VENDING MACHINE CONTROL WITH PRODUCT DELIVERY MOTOR HOME DETECTION, MOTOR SPEED CONTROL AND POWER SUPPLY

[75] Inventor: Bob M. Dobbins, Villanova, Pa.

[73] Assignee: Mars Incorporated, McLean, Va.

[21] Appl. No.: 20,371

[22] Filed: Mar. 2, 1987

[51] Int. Cl.[4] ..... G07F 9/02

[52] U.S. Cl. ..... 194/200; 221/21; 221/129; 318/490

[58] Field of Search ..... 194/200, 240, 241; 221/21, 125, 129; 318/490; 340/515, 825.35; 364/479; 324/173, 415

[56] References Cited

U.S. PATENT DOCUMENTS

| | | | |
|---|---|---|---|
| 3,691,431 | 9/1972 | Hendrickson et al. | 221/125 |
| 4,044,877 | 8/1977 | Burton | 194/200 |
| 4,220,235 | 9/1980 | Lindsey et al. | 194/240 |
| 4,225,056 | 9/1980 | Flubacker | 221/2 |
| 4,231,105 | 10/1980 | Schuller et al. | 364/900 |
| 4,233,660 | 11/1980 | Fagan | 364/104 |
| 4,284,184 | 8/1981 | Hoffman | 221/129 X |
| 4,328,539 | 5/1982 | Heeger | 364/144 |
| 4,354,613 | 10/1982 | Desai et al. | 221/129 X |
| 4,354,616 | 10/1982 | Camp | 221/129 X |
| 4,372,464 | 2/1983 | Otten | 221/14 |
| 4,458,187 | 7/1984 | Heiman | 194/200 X |
| 4,481,590 | 11/1984 | Otten | 194/200 X |
| 4,498,570 | 2/1985 | King et al. | 194/217 |
| 4,593,361 | 6/1986 | Otten | 364/479 |
| 4,696,413 | 9/1987 | Wilson et al. | 194/241 X |

*Primary Examiner*—Joseph J. Rolla
*Assistant Examiner*—Edward S. Ammeen
*Attorney, Agent, or Firm*—Davis Hoxie Faithfull & Hapgood

[57] ABSTRACT

A vending machine control apparatus has a product delivery motor home circuit and a DC power supply modulated in response to varying line voltage and/or load by a pulse width modulation circuit. The modulated DC power signal supplies power to one or more DC product delivery motors in a vending machine. Each product delivery motor has an associated switch which passes pulses, resulting from the modulation of the power supply, when the delivery motor is in its home position. A simple motor home detection circuit detects these pulses, and preferably a microprocessor control circuit connected to the detection circuit determines that a home condition exists.

13 Claims, 4 Drawing Sheets

VENDING MACHINE CONTROL WITH PRODUCT DELIVERY MOTOR HOME DETECTION, MOTOR SPEED CONTROL AND POWER SUPPLY

BACKGROUND OF THE INVENTION

1. Field of the Invention

The invention relates generally to control apparatus for controlling the operation of vending machines, and particularly to such control apparatus having improved product delivery motor home detection circuitry, speed control circuitry and power supply circuitry.

2. Description of the Prior Art

The overall operation of microprocessor controlled vending machines is generally well known to men of ordinary skill in the art. See, for example, U.S. Pat. Nos. 4,593,361, 4,498,570, 4,481,590, 4,372,464 4,354,613, 4,328,539, 4,233,660, 4,231,105 and 4,225,056. Consequently, such Operation is discussed in this application only to the extent it directly relates to the understanding of the present invention. Much of the art pertaining to vending machine product delivery motor home detection is described in U.S. Pat. No. 4,458,187 which is assigned to the assignee of the present invention and which is incorporated by reference herein. U.S. Pat. No. 4,458,187 describes a vending machine control and diagnostic apparatus for a vending apparatus having product delivery means such as an electrically operated actuator. An impedance element and a switch are connected in series with each other and in a parallel circuit with the actuator. Opening and closing of the switch are controlled by the operation of the actuator. Whether the actuator is in the appropriate position, open circuited or short circuited, is determined by the control and diagnostic apparatus' detection of changes in impedance of the parallel circuit. In several embodiments disclosed in U.S. Pat. No. 4,458,187, separate run and test signals are supplied to the actuator. In a further embodiment, a 24V DC run signal and a 5V RMS AC test signal are combined on a single wire. The test circuit in that embodiment includes a DC test circuit and an AC test circuit.

Additional prior art in the art of home detection is seen in control apparatus manufactured by Coin Acceptors, Inc. In particular, Coin Acceptors, Inc. employs a scheme which places a motor actuated single pole double throw switch in series with each motor. Home position is detected by detecting short switch openings occurring when the cam actuated switch very briefly opens and then closes at the home position. This scheme shorts the normal open and normal closed contacts of the switch. Only during switch transitions is a circuit "open" detected. This "open" is monitored and used to determine the home position. The system is fundamentally noise sensitive in that noise being received anywhere within the home detect circuitry may give a false home indication. Also, as the actual signal is non-repetitive, there is no way to "check again" the fact of the home position. Additionally, as motor current is passed through the switch contacts and is in fact switched by these contacts, switch life will be shortened.

U.S. Pat. No. 4,231,105 describes an encoding scheme for generating a series of pulses indicative of the speed of rotation of a motor in a vending machine and processing means responsive to the number of pulses during a predetermined period to remove motor power at appropriate times. This type of encoding scheme is generally well known for monitoring motor speed and position, however, it is unnecessarily complex and costly for certain vending machine applications.

Turning to the area of vending machine product delivery motor speed control, the prior art utilizes a regulated DC supply source to produce a carefully regulated and substantially constant DC supply of power in order to maintain constant speed of such motors. These schemes usually fall into two categories. In a first, series voltage regulators are used, and in a second, switch mode regulators connected to a filter which produces a relatively constant voltage output are used. The speed of the motors is usually not directly regulated, but with the normally constant load of a working DC motor, the use of a power supply which provides a relatively constant DC output voltage is sufficient to maintain relatively constant speeds of motor operation. The disadvantages of the use of such systems are the power dissipated in the series voltage regulators and the high cost of the switch mode power supply.

Almost all electronic circuits require a direct current (DC) source of power. Such a source of power is required for the electronic control systems typically found in modern vending machines because the components used, such as a microprocessor require 5V DC plus or minus 5%. Consequently, these systems include regulated supplies because the output voltage of unregulated supplies varies with load, changes in line voltage, and changes in temperature.

SUMMARY OF THE INVENTION

The present invention describes an improved vending machine product delivery motor home detection apparatus which is simple and cost effective. It further describes a low cost power supply for efficiently providing a regulated, modulated supply of voltage to both the product delivery motors of a vending machine and to the vending machine's control system.

Details of my invention are set forth below and further advantages will be apparent therefrom:

DETAILED DISCUSSION

Figure 1:
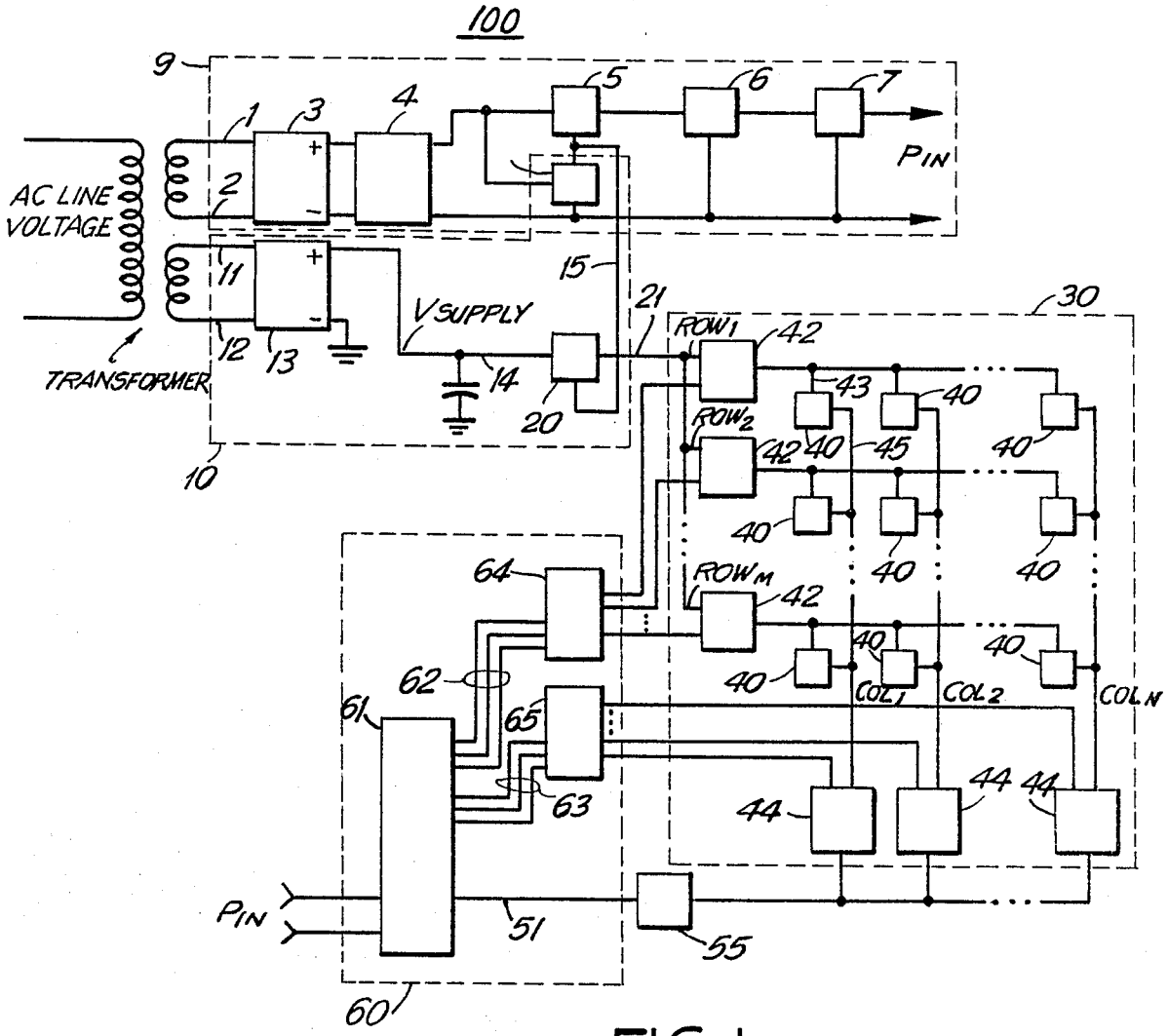
FIG. 1 is a schematic diagram of one embodiment of vending machine apparatus including a vending machine product delivery motor control circuit according to the present invention.
Figure 3:
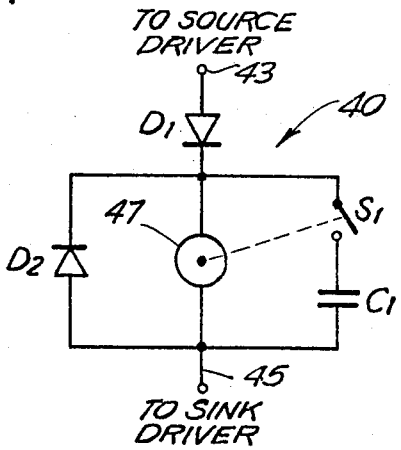
FIG. 3 is a schematic diagram illustrating the electrical connections of a motor module suitable for use in the motor control circuit of FIG. 1.
Figure 4:
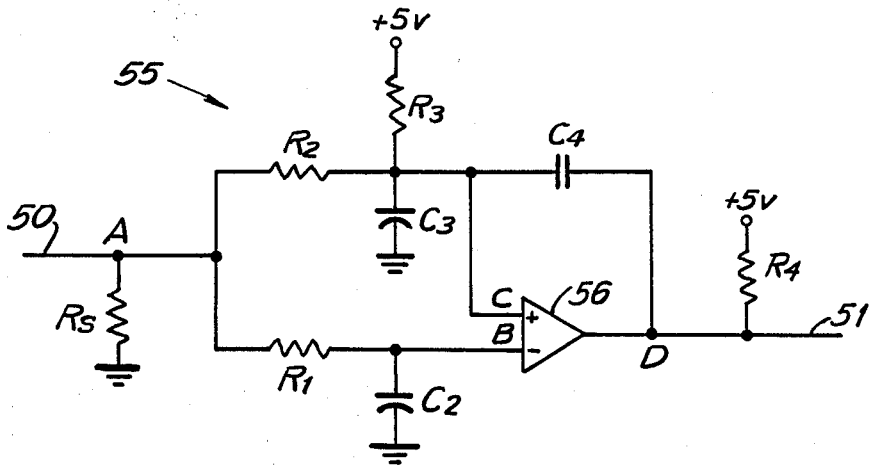
FIG. 4 is a schematic diagram illustrating the details of a motor home detect circuit suitable for use in the motor control circuit of FIG. 1.
Figure 6:
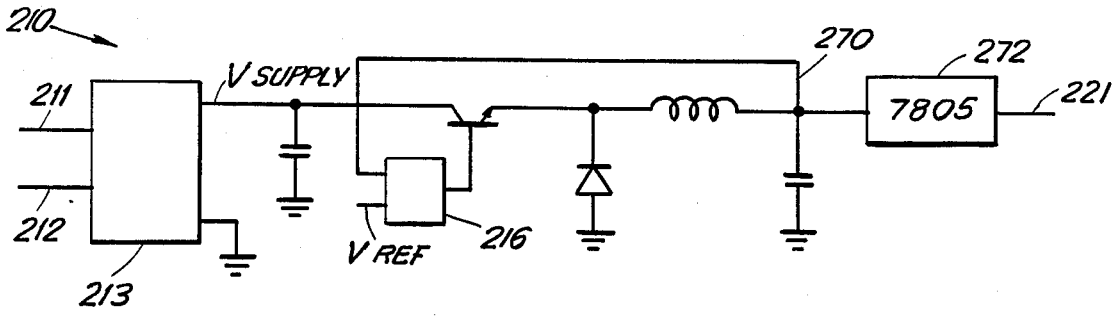
FIG. 6 PRIOR ART
FIG. 6 is a schematic diagram of a standard switch mode power supply.
Figure 7:
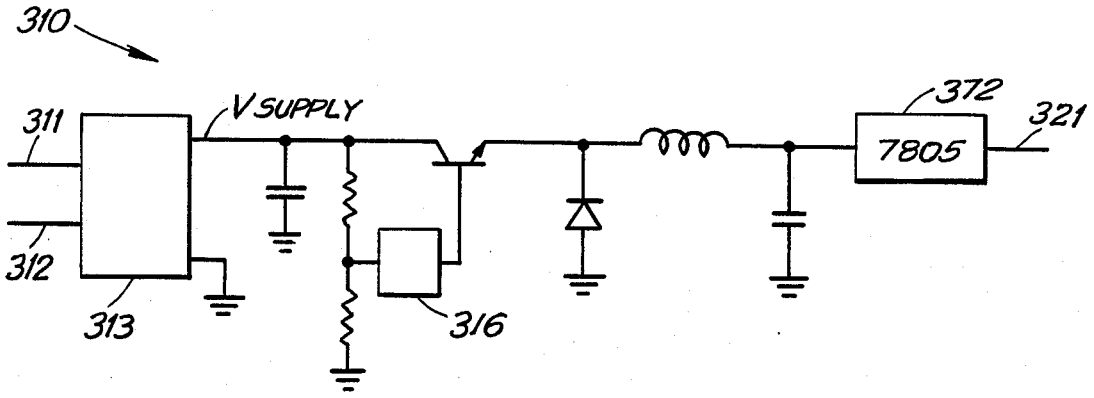
FIG. 7 is a schematic diagram of a modified line dependent switch mode power supply.
Figure 8:
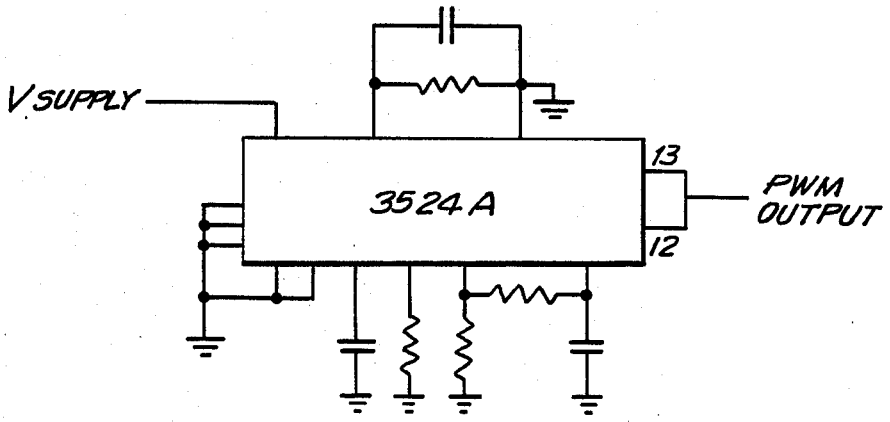
FIG. 8 PRIOR ART
FIG. 8 is a schematic diagram of a standard pulse width modulation circuit.
Figure 9:
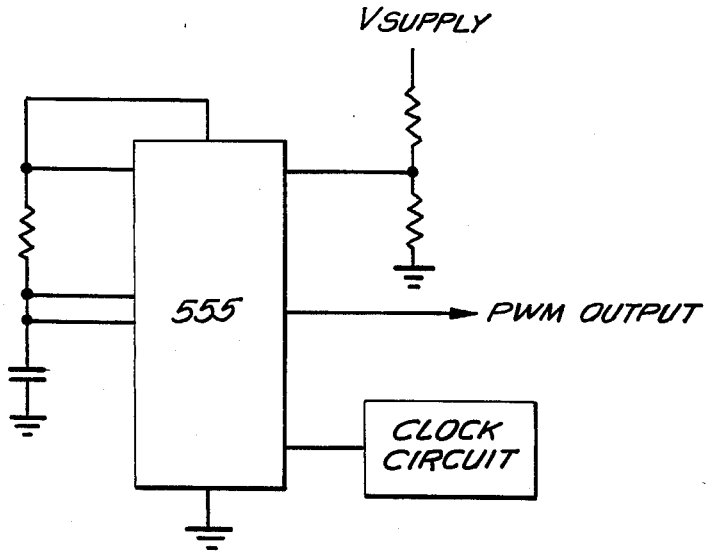
FIG.9 PRIOR ART
FIG. 9 is a schematic diagram of a modified low cost line dependent pulse width modulation circuit.

FIG. 1 illustrates in block form a first embodiment of a vending machine apparatus 100 with an improved product delivery motor home detector, motor speed control and power supply connected together according to the present invention. As shown in FIG. 1, vending machine apparatus 100 includes a first power supply 9; a second power supply 10; a plurality of motor modules 40, source drivers 42 and sink drivers 44 arranged in a motor drive, matrix array 30; a motor home detect circuit 55; and a microprocessor control circuit 60. Additional details concerning each of the major blocks of FIG. 1 are provided in subsequent figures as follows: FIG. 3 shows circuit details of an individual motor module 40; FIG. 4 shows circuit details of the motor home detect circuit 55; FIGS. 6 and 7 show circuit details of suitable power supplies for use as the power supply 10; and FIGS. 8 and 9 show details of suitable pulse width modulation circuits for use in the power supply circuits 9 and 10.

The power supply 9 supplies power for the microprocessor control circuit 60 and for vending machine components such as a display LED, but it does not provide power for the motor modules 40 which typically require a higher voltage supply. Typically, the power supply 9 will supply a source of 5 volts whereas the motor modules 40 require a source of 24 volts. Power supply 9 includes lines 1 and 2 which connect an AC bridge circuit 3 to appropriate terminals of an AC transformer which is connected to AC line voltage. The outputs of bridge circuit 3 are connected to a DC filter 4 which has one output which is DC ground. This output is connected to the microprocessor control circuit 60. A second output of DC filter 4 is connected to both a power switching circuit 5 and a pulse width modulation circuit 16. The pulse width modulation circuit 16 is further connected to DC ground, a control input of power modulator switching circuit 5, and by a line 15 a control input of a second power modulator switching circuit 20 which is part of the power supply 10. In the preferred embodiment, the pulse width modulation circuit 16 is shared by the two power supplies 9 and 10 thereby reducing the overall cost of vending machine apparatus 100.

An output line from power modulator switching circuit 5 is connected to a second filter 6. The filter 6 is connected to DC ground and also to a series regulator circuit 7. An output from series regulator circuit 7 is connected to the microprocessor control circuit 60, and this output is typically the source of a regulated supply of 5V DC throughout the control apparatus of the vending machine 100.

The power supply 10 includes lines 11 and 12 which like the lines 1 and 2 of supply 9 are connected to terminals of an AC transformer. Lines 11 and 12 connect an AC signal from the AC transformer to an AC bridge circuit 13. The positive output terminal + of AC bridge circuit 13 is connected to a smoothing capacitor C, and its negative output terminal − is connected to ground. The voltage at the positive output terminal + of AC bridge circuit 13 shall be referred to as $V_{supply}$. This voltage $V_{supply}$ is connected to the power modulator switching circuit 20 by a line 14. As discussed above, the power modulator switching circuit 20 is connected by line 15 to the pulse width modulation (PWM) circuit 16 which is shared with supply 9. Switching circuit 20 produces a modulated power output on its output line 21, the voltage of which alternates in a stepwise fashion between $V_{supply}$ and ground. This modulated power output is connected by line 21 to each of the plurality of source drivers 42 in the motor drive array 30.

As shown in FIG. 1, the plurality of motor modules 40, source drivers 42, and sink drivers 44 are connected in a matrix array 30 so that the motor modules 40 are electrically connected in rows $Row_1$–$Row_M$ and columns $Col_1$–$Col_N$. Each row of motor modules 40 has a first terminal 43 (as shown for the motor module labeled M of row one and column one) connected to an associated source driver 42 and each column of motor modules 40 has a second terminal 45 connected to an associated sink driver 44. Each source driver 42 is connected through a source driver control circuit 64 to the microprocessor 61. The microprocessor 61 produces output signals at its output lines 62 causing source drive control circuit 64 to select which of the source drivers 42 is to be turned on. Similarly, each sink driver 44 is connected through a sink driver control circuit 65 to the microprocessor 61. Microprocessor 61 produces output signals at its output lines 63 which cause the sink driver control circuit 65 to select which of the sink drivers 44 is to be turned on. By selectively turning on the source drivers 42 and sink drivers 44, the processor circuit 60 can turn on any of the motor modules 40. For example, by turning on the source driver 42 associated with row one, $Row_1$, and the sink driver 44 associated with column one, $Col_1$, the motor module 40 labeled M at the intersection of row one and column one is turned on.

Before any motor module 40 is turned on, its motor should be in an initial starting or home position. During proper operation, the motor should cause its drive shaft to rotate and ultimately return to the home position. Consequently, home position is the normal start-stop position of the motor. To insure that the motors are in the home position when they are not running and to check that all the motor modules are functioning properly, the microprocessor control circuit 60 includes the capacity to briefly energize one or all of the motor modules 40 in order to determine if they are in the home position when they should be. Once a motor is turned on, if operating properly, it rotates and causes a product to be delivered, a cup to be dropped, or some other vending function to occur. Upon completion of its vending function, the motor should return to its home position and be turned off. In order to sense the return to home and proper operation of the motor, each of the sink drivers 44 are connected by a common line 50 to the motor home detect circuit 55. The motor home detect circuit 55 is in turn connected to the microprocessor control circuit 60. As will be discussed in detail below, the power supply 10, the motor home detect circuit 55, and the microprocessor control circuit 60 combine to form an improved vending machine delivery motor home detection apparatus.

Figure 2:
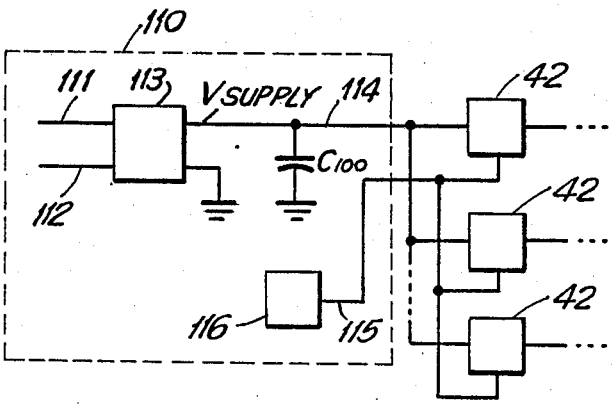
FIG. 2 illustrates an alternative power supply circuit suitable for use with the motor control circuit of FIG. 1.

First, before discussing operation of the motor home detect circuit 55 in greater detail, FIG. 2 shows an alternate power supply 110 suitable for use in place of the power supply 10 of FIG. 1. The power supply 110 is similar to the power supply 10; however, the power modulator switching circuit 20 of power control circuit 10 is eliminated in the power supply circuit 110. In power supply circuit 110, lines 111 and 112 connect an AC signal to an AC bridge circuit 113. A line 114 connects the output voltage $V_{supply}$ from an AC bridge circuit 113 to a capacitor $C_{100}$ and directly to each of the plurality of source drivers 42. Also, a pulse width modulation circuit 116 is connected by a line 115 to each of the source drivers 42. The power control circuit 110 provides a particularly simple and inexpensive circuit for providing a modulated source of motor drive power because it uses a very small number of components. If a shared pulse width modulation circuit is employed as was the case in FIG. 1, the power supply 110 can be added by adding only two components, the bridge circuit 113 and the capacitor $C_{100}$. Even though the voltage $V_{supply}$ in FIG. 2 is unregulated, an effectively regulated supply of voltage is nonetheless provided to a selected motor module 40 as will be explained below.

The effective voltage to the selected motor module using a supply such as the supplies 10 and 110 is the average voltage as determined by the voltage $V_{supply}$ times the duty cycle of the voltage signal connected to the motor module. Therefore, for example, if the line voltage increases and $V_{supply}$ is consequently increased, while the duty cycle proportionately decreases, as would be the case for a properly designed switch mode power supply, the power to the motor will remain approximately constant. In FIGS. 1 and 2, the PWMs 16 and 116 insure that the duty cycle varies appropriately. Consequently, the speed of the motor of any selected motor module 40 is maintained relatively constant.

Turning to FIG. 3, FIG. 3 illustrates the details of a suitable motor module 40 for use in the embodiment of FIG. 1. As shown in FIG. 3, motor module 40 includes a motor or actuator 47, two diodes $D_1$ and $D_2$, a motor home switch $S_1$ and a capacitor $C_1$. The motor home switch $S_1$ is wired in series with the capacitor $C_1$, and the series connected switch-capacitor pair is wired in parallel with the motor 47 and the diode $D_2$. The diode $D_1$ is connected in series with the diode $D_2$, motor 47 and motor home switch $S_1$. Further, motor 47 mechanically controls the operation of switch $S_1$, as illustrated by the dashed line of FIG. 3 and shown schematically in FIG. 3A.

Figure 3A:
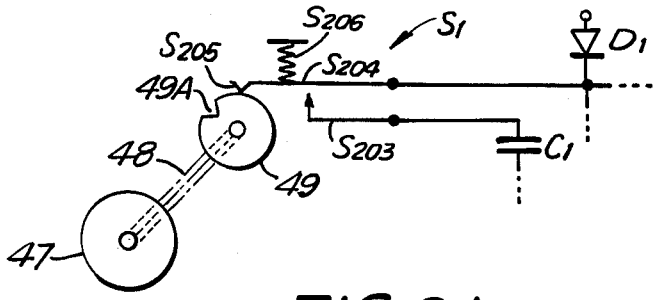
FIG. 3A is a schematic drawing of the mechanical connection of a motor, cam and switch of the motor module of FIG. 3.

In FIG. 3A, the motor 47 is mechanically coupled by a rotating drive shaft 48 to a cam 49. The drive shaft 48 is also mechanically coupled to drive an actual product delivery means such as a delivery spiral in a typical glassfront machine (not shown). Switch $S_1$ has a stationary contact $S_{203}$ and a moveable contact arm $S_{204}$. The outer end of the contact arm $S_{204}$ has a protrusion $S_{205}$ which rests on the surface of the cam 49. A spring $S_{206}$ presses the protrusion against the cam 49. The cam 49 has an indentation 49A in its surface. When the motor 47 is at its home position, the protrusion $S_{205}$ is pressed by the spring $S_{206}$ into the indentation 49A, so that switch contacts $S_{203}$ and $S_{204}$ are connected. When the actuator is not at its home position as shown in FIG. 3A, the cam 49 holds the switch arm $S_{204}$ in a position such that it does not contact the fixed contact $S_{203}$. While the switch $S_1$ in FIG. 3 is arranged to be normally closed when motor 47 is in the home position and open when motor 47 is away from home position as discussed above, it will be clear to those skilled in the art that a switch which is open when motor 47 is in the home position and closed when away from home position can also be employed without departing from my invention if the motor module 40 is appropriately redesigned.

FIG. 4 illustrates the details of a presently preferred motor home detect circuit 55. As discussed above, the motor home detect circuit 55 is connected to each of the sink drivers 44 by the common line 50. As shown in FIG. 4, the line 50 is connected through a current sense resistor $R_s$ to ground. The resistor $R_s$ is preferably a thermistor to provide short circuit protection. As the current through a thermistor increases beyond a specified limit, the thermistor heats up and its resistance increases dramatically. This increased resistance of $R_s$ limits the current that can flow through the motor because the resistor $R_s$ is in series with the motor. Consequently, as the resistance of $R_s$ increases, the voltage drop across $R_s$ increases while the voltage across the motor decreases thereby decreasing the motor current. Additionally, as the voltage across $R_s$ increases beyond the cutoff region of the sink driver 44, the sink driver 44 will turn off thereby shutting off current to the motor. Once the voltage across $R_s$ drops below the cutoff region of sink driver 44, the motor will again be energized. This ON-OFF cycling will repeat for a brief period until the microprocessor control circuit 60 fails to detect that the motor has returned to home within the appropriate amount of time. The microprocessor control circuit 60 will then disable the failed motor unit until it is serviced. The use of a thermistor helps avoid damage by short circuit currents to the sink driver 44 or other electronic components in the interval before the motor is disabled.

Figure 5:
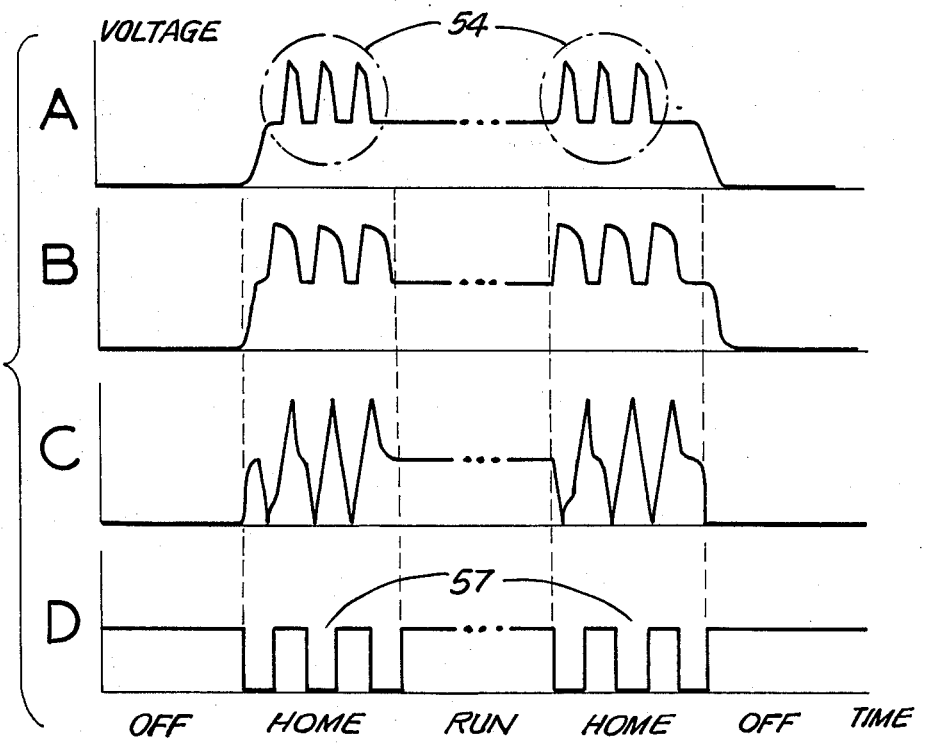
FIG. 5 is a series of graphs illustrating output signals observed at various points in the motor home detect circuit of FIG. 4.

The voltage drop, $V_A$, across the resistor $R_s$ for a cycle of operation, from OFF, to ON through a complete cycle of rotation from home to home, of a motor 47 is illustrated in waveform A of FIG. 5. The voltage $V_A$ is connected to the remainder of the motor home detect circuit 55 which consists of the following components:

$R_1$: 100 ohms
$R_2$, $R_4$: 10 kilohms
$R_3$: 62 kilohms
$C_2$: 180 picofarads
$C_3$, $C_4$:0.1 microfarads
Comparator 56 LM 339 as shown in FIG. 4. The point A and voltage $V_A$ are connected through resistor $R_1$, firstly, to capacitor $C_2$ which is connected to ground, and secondly to the inverting (−) input of the comparator 56. The point A and voltage $V_A$ are also connected through resistor $R_2$ to firstly, capacitor $C_3$ which is connected to ground, secondly, through resistor $R_3$ to +5V and thirdly, to the noninverting (+) input of the comparator. The capacitor $C_4$ is a feedback capacitor connecting the output and the noninverting (+) input of comparator 56. The output of the comparator 56 is also connected to +5V through the resistor $R_4$ and to the microprocessor control circuit 60 by an output line 51.

The motor home detector circuit 55 of FIG. 4 operates as follows. As described above, $R_s$ is the sense resistor and in a preferred embodiment, resistor $R_s$ is a thermistor to provide short circuit protection. $R_1$ and $C_2$ represent a high frequency filter to eliminate spikes at the inverting (−) input of comparator 56. The signal at the inverting (−) input of comparator 56 is representative of the voltage $V_A$ across $R_s$ except voltage spikes are filtered out.

$R_2$ and $C_3$ form a low pass filter and provide an essentially DC level at the noninverting (+) input of the comparator 56 (assuming $C_3$ not present). $R_3$ provides a DC offset to the signal at the noninverting (+) input of the comparator to insure the DC signal at the noninverting (+) input is normally greater than the DC signal at the inverting (−) input. The low pass filter allows the voltage at the noninverting (+) input of the comparator 56 to be automatically adjusted with changing load factors. Different motor load factors will be observed for different product delivery motors, and the load factor for an individual motor will vary during delivery. For example, a product may briefly jam causing the motor trying to deliver that product to present an increased load. As the motor current is increased, the voltage across the sense impedance $R_s$ is increased. While the voltage $V_B$ at the inverting (−) input of comparator 56 increases, the filtered voltage $V_C$ appearing at the noninverting (+) input of comparator 56 is also increased. Consequently, $V_B$ will not exceed $V_C$ solely because of an increased motor load factor as both will move. This joint movement assures the relative independence of the motor home detection circuit 55 with respect to motor load changes. This independence avoids false "home" indications.

During motor home time, switch $S_1$ is closed, and consequently, when a modulated voltage appears across $R_s$ (waveform A of FIG. 5) and hence is connected to the inverting (−) input of the comparator 56 (waveform B of FIG. 5), the peaks of this home signal exceed the DC signal at the noninverting (+) input (waveform C of FIG. 5) causing the output of comparator 56 to oscillate (waveform D of FIG. 5). In the home position, the closed switch $S_1$ and the capacitor $C_1$ allow the modulated DC waveform to be passed on line 50 to the motor home detect circuit 55. This DC voltage which alternates between $V_{supply}$ and ground provides the signal necessary to detect a home condition. Unlike the prior art, only a single supply and a single detection circuit are employed. When the switch $S_1$ is open, the highpass capacitor $C_1$ is removed from the circuit and only the "lowpass" motor is present.

The feedback capacitor $C_4$ is used to stretch the "home" pulses by providing hysteresis. Alternatively, capacitor $C_4$ can be selected to provide a constant low output of comparator 56 for the duration of the time that home pulses 54 are present. In the circuit of FIG. 4, both on and off motors look alike to microprocessor control circuit 60 as will be discussed in greater detail below in connection with a discussion of FIG. 5.

The waveforms A, B, C and D illustrate the voltage signal appearing at the points A, B, C, and D respectively of FIG. 4. The voltage at point A is the voltage drop across the sense resistor $R_s$, the voltage at point B is the voltage at the inverting (−) input of comparator 56, the voltage at point C is the voltage at the noninverting (+) input of comparator 56, and the voltage at point D is the voltage at the output of comparator 56. FIG. 5 illustrates the voltage appearing at these points for a cycle of operation of a motor from an off state through a complete on state in which the motor's shaft makes a complete rotation starting from the home position and then returning to the home position. Because, the home position will typically occur during approximately 10% of a single rotation of cam 49, FIG. 5 shows the "run" portion of the cycle with ellipsis to indicate that the run period is significantly longer than can be conveniently shown in FIG. 5. This cycle of operation is indicated in FIG. 5 by the legends, OFF, HOME and RUN. As can be seen from waveform D of FIG. 5, both the OFF and RUN motor states result in the same voltage appearing at the output of comparator 56. Consequently, as noted above both ON and OFF motors appear alike to the microprocessor control circuit 60. However, when the motor returns to home, it is seen that because of the modulated DC supply signal which is passed through the sense resistor $R_s$ when switch $S_1$, is closed (as illustrated by spikes 54 in waveform A of FIG. 5), a series of pulses 57 results at the output of comparator 56 (as illustrated in waveform D of FIG. 5) when the motor 47 is in the home position. By proper choice of the feedback capacitor $C_4$ as described above, the output of comparator 56 could be held low during the entire home time. The microprocessor control circuit 60 can readily be programmed to detect the pulses 57 and to turn OFF the source driver 42 and the sink driver 44 for the motor 47 when a return to home is detected or if a return to home is not detected within a reasonable amount of time.

FIG. 6 is a schematic diagram of a prior art switch mode power supply 210 suitable for use as the power supply 10 of FIG. 1. Lines 211 and 212 connect an AC signal to an AC bridge circuit 213. Supply 210 uses feedback from its regulated voltage output appearing at point 270 to adjust the duty cycle of its pulse width modulation circuit 216. The supply 210 compensates for input line changes, and load changes and maintains a constant voltage output at its output 221. Series regulator 272 of supply 210 is shown as an LM 7805 chip which is available from National Semiconductor and is optional. The series regulator 272 does, however, offer advantages in final output regulation and short circuit protection of supply 210.

FIG. 7 is a schematic diagram of a second switch mode power supply 310. Lines 311 and 312 connect an AC signal to an AC bridge circuit 313. The prior art supply 210 of FIG. 6 is now modified to compensate the switching duty cycle dependent on input voltage only. This requires the desired output regulated voltage at output line 321 to be set "open-loop". That is to say, it is set by virtue of calculated component values and not by feedback of a reference voltage. Therefore, the output voltage of supply 310 is not as tightly controlled as that of the circuit of FIG. 6. However, this is little sacrifice since a series regulator 372 which is also shown as the LM 7805 chip provides the same precise output voltage for supply 310 as is achieved with supply 210.

The advantage of the supply 310 of FIG. 7 is that it is an inexpensive voltage regulator which has high efficiency and which provides a pulse width modulated signal proportional to the input which can then be used in the circuit of FIG. 1 to provide a very inexpensive regulated voltage power supply 10. Further, the motor supply 310 satisfies the requirements of the present invention by providing the modulated signal needed for home detection.

With either the supply 210 or 310, the dual advantages of speed control of the motor and home detect signals are provided. Speed control is achieved by virtue of the modulated duty cycle which varies inversely with changes in the level of $V_{supply}$. Home detection is achieved by virtue of detection of the switching source voltage which is available to be served through the high pass capacitor $C_1$ and the motor switch $S_1$ when the motor is in its home position.

Figure 10:
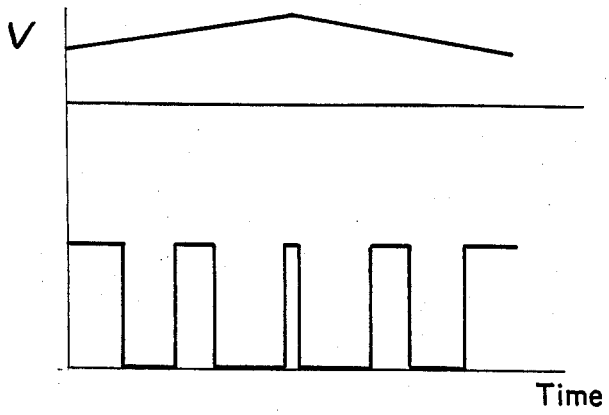
FIG. 10 is a pair of graphs illustrating the output of the modified low cost line dependent pulse width modulation circuit of FIG. 9.

The relationship of the regulated output voltage in FIG. 7 to its nominal input voltage is the same as the relationship to the desired motor control voltage to its nominal input voltage. The duty cycle on the output at line 321 of FIG. 7 is dependent on the input voltage $V_{supply}$ as illustrated in FIG. 10. The higher the input voltage, the smaller the duty cycle resulting in a regulated filtered output on line 321 of supply 310.

For each of the power supplies 10, 110, 210 and 310 discussed above, the duty cycle of its output signal is controlled by its respective pulse width modulation circuit 16, 116, 216, 316. Suitable pulse width modulation circuits for use as the pulse width modulation circuits 16, 116, 216 or 316 are shown in FIGS. 8 and 9.

The pulse width modulation circuit shown in FIG. 8 is based on a 3524A chip from Signetics configured as shown to produce a satisfactory PWM output. The configuration shown is a standard one for the 3542A chip described in detail in literature for the chip. Alternatively, the pulse width modulation circuit of FIG. 9 may be used. This pulse width modulation circuit is based on a 555 chip from Texas Instruments configured as shown. Again, the configuration shown is a standard one for the chip. As a further alternative, some other PWM circuit might be used so long as the proper frequency of modulation and the proper duty cycle are maintained. For the presently preferred embodiment, the frequency of modulation is desired to be in the range of 25–40 kHz.

I claim:

1. A vending machine apparatus comprising at least one product delivery means, said product delivery means comprising an electrically operated actuator for delivery of products, said actuator having a home position, an impedance element and a circuit opening switch responsive to the position of the actuator, the impedance element and the switch being connected electrically in series with each other and in an electrically parallel circuit with the actuator; the circuit comprising the actuator, the impedance element and the circuit opening switch being a motor module; a first modulated DC power supply for supplying a single modulated power signal to the electrically operated actuator for regulating its speed during delivery of products, said first modulated power supply comprising a power supply for providing a power signal and a means for modulating said power signal dependant on at least one of the line voltage and load; opening and closing of the switch in said motor module being controlled by the operation of the actuator such that when the actuator is in the home position the switch and the impedance element will pass the modulated DC power signal and such that when the actuator is not in the home position, the switch is open and the modulated DC power signal is filtered by the actuator; and means electrically connected to said motor module for detecting the operational condition of the actuator and the home position of the actuator by detecting the single modulated power signal at the output of said motor module.

2. The vending apparatus of claim 1 wherein the impedance element is a capacitor.

3. The vending apparatus of either claim 1 or claim 2 wherein the actuator's home position is its normal start-stop position and the switch is open except when the actuator is in the home position.

4. The vending apparatus of either claim 1 or claim 2 wherein a plurality of motor modules are arranged in an electrical matrix with one electrical terminal of each motor module connected in common with each of the corresponding terminals of the motor modules in the same row and another electrical terminal of each motor module connected in common with each of the corresponding terminals of the motor modules in the same column is connected in series with each of the matrix columns.

5. The vending apparatus of claim 3 wherein a plurality of motor modules each having a first and a second electrical power terminal are arranged in an electrical matrix with one electrical terminal of each motor module connected in common with each of the corresponding terminals of the motor modules in the same electrical matrix row and another electrical terminal of each motor module connected in common with each of the corresponding terminals of the motor modules in the same electrical matrix column, and wherein said means for detecting the home position is connected in series with each of the matrix columns.

6. The vending apparatus of claim 1 wherein the single modulated power signal has a duty cycle and said means for modulating said power signal comprises a pulse width modulation circuit which controls the duty cycle of the output of the DC power supply to compensate for varying line voltage or load.

7. The vending apparatus of claim 6 wherein a frequency of modulation of the output of the DC power supply is between 25 Hz and 40 kHz.

8. The vending apparatus of claim 6 wherein the pulse width modulation circuit causes the duty cycle of the output of the first modulated DC power supply to vary so that the output voltage of the DC power supply is effectively regulated and acceptable speed control of the actuator is thereby maintained.

9. The vending apparatus of claim 1 wherein said means for detecting comprises a sense resistor wired in series with a terminal of the motor module.

10. The vending apparatus of claim 9 wherein the sense resistor is a thermistor.

11. The vending apparatus of claim 1 further comprising a microprocessor based control means for controlling the overall operation of the vending apparatus, said microprocessor based control means comprising a second modulated DC power supply, wherein said first modulated DC power supply and said second modulated DC power supply share a common pulse width modulation circuit; said first and second modulated power supplies each comprising in series a source of power and a switch and said pulse width modulation circuit has an output connected to each of said switches such that the output of the switches provides modulated DC power signals.

12. The apparatus of claim 1 wherein the modulated DC power supply is a line regulated power supply.

13. A vending machine apparatus comprising:

a first regulated power supply means for supplying a regulated supply of 5V DC;

a second unregulated power supply means for supplying an unregulated supply of DC voltage;

a plurality of source drivers;

a plurality of sink drivers;

a plurality of motor modules comprising a DC motor electrically connected in a circuit with a motor home switch and a capacitor, said motor home switch and capacitor connected in a series pair which is connected in parallel with the DC motor, and said motor home switch being responsive to the position of said DC motor;

said source drivers, sink drivers and motor modules electrically connected to form a motor module drive matrix;

said second power supply means connected to the source drivers;

a pulse width modulation means also connected to the source drivers for controllably varying the cycle of the DC voltage supplied through the source drivers to achieve effective voltage regulation and motor speed control;

a motor home position detect means connected in series with the sink drivers having an output indicative of said position of said D.C. motors; and a microprocessor control means connected to said first regulated power supply means and to the output of said motor home detect means for determining the position of the DC motors in the motor modules.

* * * * *

UNITED STATES PATENT AND TRADEMARK OFFICE
CERTIFICATE OF CORRECTION

PATENT NO. : 4,785,927
DATED : November 22, 1988
INVENTOR(S) : Dobbins

It is certified that error appears in the above—identified patent and that said Letters Patent is hereby corrected as shown below:

Column 1, line 17, insert --,-- after "4,372,464".

Column 1, line 19, delete "Operation", and insert therefor -- operation --.

Column 7, line 12, delete "$V_C$appear-" and insert -- $V_C$ appear --.

Column 7, line 38, delete "_" preceeding "pulses".

Claim 13, column 10, line 57, insert -- each -- after "modules".

Claim 13, column 12, line 2, delete "D.C." and insert therefor -- DC --.

Signed and Sealed this

Twenty-third Day of May, 1989

*Attest:*

DONALD J. QUIGG

*Attesting Officer*

*Commissioner of Patents and Trademarks*